US005346150A

United States Patent [19]

Volin

[11] Patent Number: 5,346,150

[45] Date of Patent: Sep. 13, 1994

[54] TAIL GAP WINDER

[75] Inventor: Leonard M. Volin, Grant Township, Washington County, Minn.

[73] Assignee: Minnesota Mining and Manufacturing Company, St. Paul, Minn.

[21] Appl. No.: 38,555

[22] Filed: Mar. 26, 1993

Related U.S. Application Data

[63] Continuation of Ser. No. 823,961, Jan. 21, 1992, abandoned.

[51] Int. Cl.[5] ..... B65H 19/28

[52] U.S. Cl. ..... 242/527.1; 242/531; 242/532.3

[58] Field of Search ..... 242/56 R, 65, 66

[56] References Cited

U.S. PATENT DOCUMENTS

| | | | |
|---|---|---|---|
| 2,681,771 | 6/1954 | Haskell | 242/56 A |
| 2,872,126 | 2/1959 | Rockstrom et al. | 242/65 |
| 2,942,796 | 6/1960 | Gurney et al. | 242/56 A |
| 3,567,552 | 3/1971 | Heuff et al. | 242/56 R X |
| 3,794,255 | 2/1974 | Harmon et al. | 242/56 R |
| 3,892,012 | 7/1975 | Keferstein | 242/64 X |
| 4,157,794 | 6/1979 | Brandauer et al. | 242/66 |
| 4,422,588 | 12/1983 | Nowisch | 242/56.3 |
| 4,485,979 | 12/1984 | Dropczynaki | 242/56 |
| 4,487,377 | 12/1984 | Perini | 242/56.8 |
| 4,601,441 | 7/1986 | Oinonen et al. | 242/56 |
| 4,635,867 | 1/1987 | Kytonen | 242/56 |
| 4,659,029 | 4/1987 | Rodriguez | 242/56 |
| 4,678,133 | 7/1987 | Suzuki | 242/56 |
| 4,700,905 | 10/1987 | Oppelt et al. | 242/67 |
| 4,709,867 | 12/1987 | Oinonen | 242/56 R |
| 4,712,459 | 12/1987 | Walkiewicz, Jr. et al. | 83/171 |
| 4,723,724 | 2/1988 | Bradley | 242/56 |
| 4,749,139 | 6/1988 | Snygg | 242/56 |
| 4,775,110 | 10/1988 | Welp et al. | 242/56.8 |
| 4,842,209 | 6/1989 | Saukkonen | 242/56 |
| 4,852,820 | 8/1989 | Looner | 242/56 |
| 4,856,725 | 8/1989 | Bradley | 242/66 |
| 4,858,843 | 8/1989 | Gierse et al. | 242/65 |
| 4,867,387 | 9/1989 | Schonmeier | 242/65 |
| 4,919,351 | 4/1990 | McNeil | 242/56 |
| 4,964,585 | 10/1990 | Negrussi | 242/56 R |
| 5,031,850 | 7/1991 | Biagiotti | 242/56 R X |
| 5,137,225 | 8/1992 | Biagotti | 242/56 R X |
| 5,150,848 | 9/1992 | Consarni | 242/56 R |

FOREIGN PATENT DOCUMENTS

| | | |
|---|---|---|
| 0335028 | 10/1989 | European Pat. Off. . |
| 2923559 | 1/1981 | Fed. Rep. of Germany . |
| 3217628 | 3/1983 | Fed. Rep. of Germany . |
| 2019873 | 7/1970 | France . |
| 2336334 | 7/1977 | France . |
| 2387102 | 11/1978 | France . |
| 2499958 | 8/1982 | France . |
| WO87/06218 | 10/1987 | PCT Int'l Appl. . |
| 1137221 | 12/1968 | United Kingdom . |
| 1164885 | 9/1969 | United Kingdom . |
| 1167767 | 10/1969 | United Kingdom . |
| 1207080 | 9/1970 | United Kingdom . |

OTHER PUBLICATIONS

Research Disclosure No. 249 (Jan., 1985), Emsworth, Great Britain, pp. 77–79.

*Primary Examiner*—Daniel P. Stodola
*Assistant Examiner*—John P. Darling
*Attorney, Agent, or Firm*—Gary L. Griswold; Walter N. Kirn; Peter L. Olson

[57] ABSTRACT

The tail gap winder transfers a web from a first wind-up spindle to a second wind-up spindle by, immediately after the web is cut, pivoting the idler roller to lengthen the distance between the idler roller and the rotating drum to create a gap between the cut ends of the web; moving the first wind-up spindle away from the rotating drum surface as the gap passes under the first wind-up spindle location; moving the second wind-up spindle into contact with the rotating drum surface as the first wind-up spindle moves away; and winding the incoming cut edge around the second wind-up spindle. The idler roller pivots toward the rotating drum to decrease the distance between the idler roller and rotating drum and to take up the extra length of web during the winding portion of the operating cycle.

20 Claims, 1 Drawing Sheet

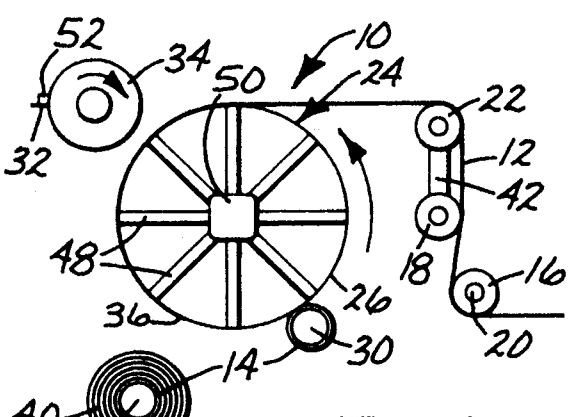
Fig. 1A
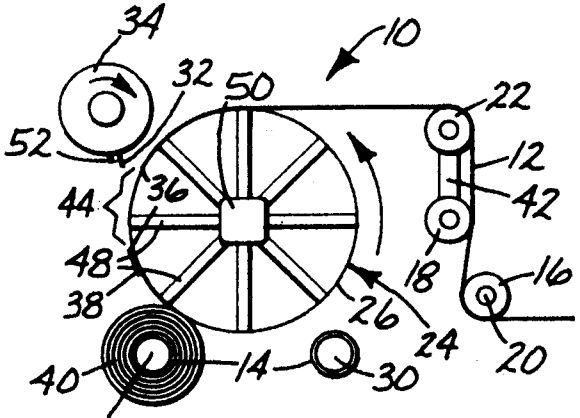
Fig. 1B
Fig. 1C
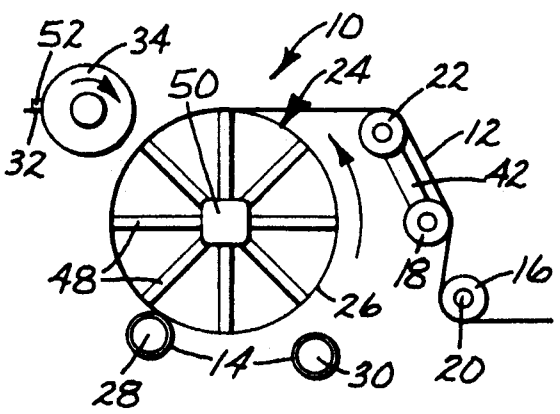
Fig. 1D
Fig. 1E
Fig. 1F

TAIL GAP WINDER

This is a continuation of application Ser. No. 07/823,961 and filed Jan. 21, 1992, now abandoned.

TECHNICAL FIELD

The present invention relates to log roll winders. More particularly, the present invention relates to log roll winders having improved web transfer between wind-up spindles.

BACKGROUND OF THE INVENTION

Most known log roll winders cut the web while the web is in the air, rather than against a drum. As the knife cuts, it forces the web against a new core. However, as the tail of the web is not supported, the web, particularly thin webs, will not lay down smoothly against the core and wrinkles are produced on the outer wraps. Winders of this type are made by Fuji Tekko.

U.S. Pat. No. 4,775,110 to Welp et al. describes a winding system in which a complex cutting system is used to sever the web. One cutter perforates the web along a line and the web is braked to sever the web. Cutting is not performed on the fly. A hot wire can be used as another cutter and a vacuum can be used on the feed drum to secure the web.

Some continuous, high speed log roll winders which wind a continuous web of material around large rolls or drums transfer the web to a core on a wind-up spindle disposed against the drum. In one system attempted by 3M Company, the assignee of this invention, the winding is transferred from one wind-up spindle to another simply by moving the wind-up spindles against and away from the rotating drum. However, as the web which typically travels at speeds of 120 m/min (although the speed can vary), it requires precise timing. When transferring from the first wind-up spindle to the second wind-up spindle, the first wind-up spindle must be lifted off of the rotating drum before the cut end arrives. In doing this, the last portion of the web wrapped on the first wind-up spindle is uncontrolled and must be prevented from wrinkling. When transferring from the second to the first wind-up spindle, the first wind-up spindle must be moved against the rotating drum before the cut end arrives. Then the web is peeled off of its core on the second wind-up spindle while being prevented from wrinkling.

A roll winder made by Stahlkontor Maschinenbau GmbH winds a web at only one wind-up location. The web, drum, and wind-up roll stop for the web to be cut before the drum. Following the cut, the drum and roll of web resume turning to wind up the tail of the web while the incoming web remains stopped. Next, the roll of web is unloaded, and an empty core is loaded in its place. Finally, the winder begins winding on the new core. Thus, this winder does not cut and transfer web on the fly. If the winder is used to wind on line at the end of a continuous web maker, an accumulator is required to absorb incoming web during the cut and transfer, and web speeds are limited to 70 m/min to prevent tension problems. Additionally, the Stahlkontor machine cuts the web before it contacts the drum, leaving the web prone to wrinkling.

In the rewinder of U.S. Pat. No. 4,487,377 to Perini, after the web is cut, the leading edge of the web is permitted to fly rearwardly off of the main winding drum. This folded back portion is subsequently adhered to a core to begin winding another roll. No function for folding back the beginning portion of the web is disclosed.

SUMMARY OF THE INVENTION

The present invention overcomes the disadvantages of known log roll winders by separating and creating a gap between the cut ends of the web on the surface of the drum during the cut and transfer operation of the winder. The web is always supported during the cut and transfer. This enables the winder to cut and transfer the web on the fly at speeds of 137.2 m/min (450 ft/min) or more. This also permits winding and cutting the web against the drum and without wrinkling the web.

The web first passes around a spreader roller, if needed, and then travels to and around the retractable idler roller before being wrapped partially around the rotating drum. The rotating drum passes the web onto one of the wind-up spindles. The web begins winding around the first wind-up spindle and onto its core which is mounted on the wind-up spindle. When the first wind-up spindle has received the required length of web, the knife rotates at a surface speed equal to the surface speed of the rotating drum.

The knife cuts the web as it rotates against the rotating drum and a tab is applied. As the knife cuts the web, the idler roller pivots on its pivoting arm away from the rotating drum to lengthen the distance between the idler roller and the drum. The idler roller pivots at a speed approximately equal to the web speed. This causes one end of the web to slide on the surface of the drum. Since the rotating drum continues to rotate at a constant speed, this creates a gap between the cut ends of the web. A vacuum is applied to the web through the rotating drum to keep the web in close contact with the drum during winding. When the web slides on the drum surface by pivoting the idler roller, the vacuum controls the sliding force and maintains a constant line tension.

To transfer the winding from the first wind-up spindle to the second wind-up spindle, the first wind-up spindle is moved away from the drum surface as the gap passes the first wind-up spindle location. This causes the incoming cut edge of the web to pass by the first wind-up spindle and continue onto the second wind-up spindle. The second wind-up spindle is moved into contact with the rotating drum surface as the first wind-up spindle moves away, and the incoming cut edge adheres to and begins wrapping around the core on the second wind-up spindle.

During the winding portion of the operating cycle, the idler roller slowly returns toward the rotating drum. The distance between the idler roller and rotating drum decreases while the drum speed increases slightly to maintain constant line tension and to take up the extra length of web.

When the desired amount of web is wound around the core on the second wind-up spindle, the winding is transferred from the second wind-up spindle to the first wind-up spindle. As the knife cuts the web, the idler roller is pivoted to its gap position to slide the web on the surface of the rotating drum and create a tail gap. The first wind-up spindle is moved into contact with the drum surface as the gap passes the first wind-up spindle location to cause the incoming edge of the web to wind on the first wind-up spindle. The second wind-up spindle remains in contact with the rotating drum until the tail end of the web is completely wound around its core.

BRIEF DESCRIPTION OF THE DRAWINGS

FIGS. 1A–1F are sequential schematic views of the winding system of the present invention.

DETAILED DESCRIPTION OF PREFERRED EMBODIMENTS

The winding system 10 of the present invention, shown in FIG. 1, can be used in conjunction with most known tapes. After the web 12 is processed it is to be wound on cores 14. The winding system 10 includes a "tail gap mechanism" and permits transferring the web 12 between cores 14 on the fly and includes numerous rollers 16, one of which is shown. The winding system 10 also includes a stationary gapping roller 18 around which the web 12 winds. The roller 18 can serve to spread the web 12 and eliminates wrinkles before the web 12 travels to the rotating drum 24. A tension sensor 20 is mounted on one roller 16 to measure web tension and adjust the speed of the rotating drum 24 to maintain a set tension. The web 12 then travels to a retractable primary gapping roller or idler roller 22 which is disposed downline of the roller 18. The idler roller 22 is pivotable on a radius centered at the center of the roller 18. Preferably, the idler roller 22 and the roller 18 have the same diameter and the same circumference.

A rotating drum 24 is disposed downline of the idler roller 22 such that the web 12 travels in intimate contact with a portion of the surface 26 of the rotating drum 24 after passing the idler roller 22. The rotating drum 24 has an outer surface 26 covered with urethane rubber or other material which firmly supports the web 12 such that a cutting knife will penetrate the web 12 when the knife is pressed against the web 12. The drum surface 26 can be steel as long as the knife travel is precisely controlled to avoid knife damage. Also, the surface 26 can have a narrow groove which would engage the knife such that the edges of the groove would support the web 12 close to the cut while the cut is actually made in the open air space between the edges of the groove. Preferably, the web 12 has an adhesive side which faces outwardly when the web 12 is wrapped around the rotating drum 24.

Two wind-up spindles 28, 30 are located adjacent the rotating drum 24 and receive the cores 14 on which the web 12 is wound. The first wind-up spindle 28 is located relatively upline of the second wind-up spindle 30. Both wind-up spindles 28, 30 are movable between a first position in contact with the rotating drum 24 and a second position spaced away from the rotating drum 24.

A cutting knife 32 is located upline of both wind-up spindles 28, 30 and cuts the web 12 as the web 12 rotates against the rotating drum 24. The knife 32 is mounted on a rotating wheel 34. The knife 32 cuts the web 12 against the rotating drum 24 which holds the cut ends 36 of the web 12 to prevent wrinkling. A tab 38 is applied on at least one of the cut ends 36 of the web 12. The web cutting and tab application can be performed on the fly without stopping the winding process such that log rolls 40 can be wound on line and at machine speeds on a continuous basis.

The idler roller 22 is mounted on an arm 42 which pivots around the center of the roller 18. The idler roller 22 pivots from a first position in which winding occurs and a second position which lengthens the distance, known as the pass line, between the idler roller 22 and the rotating drum 24 to create a gap 44 between the cut ends 36 of the web 12. Immediately after the web 12 is cut the idler roller 22 pivots to lengthen the pass line to cause the web 12 to slide on the surface 26 of the rotating drum 24 and create the gap 44 between the cut ends 36 of the web 12. The idler roller 22 is pivoted by an index mechanism (not shown) which can be a mechanical cam or an electrical drive such that the pivot speed is a function of the line speed.

The rotating drum 24 includes a series of holes 48 on its surface which are connected to a source of vacuum 50 through the rotating drum 24. The vacuum 50 provides a mechanism for increasing friction between the web 12 and the rotating drum 24 and for maintaining the web 12 in close contact with the rotating drum 24 during winding. When the web 12 slides on the rotating drum surface 26 by pivoting the idler roller 22, the vacuum 50 controls the sliding force of the web 12 on the rotating drum 24 and to maintain a constant line tension.

The operation of the winding system 10 is as follows, as shown in FIG. 1. The web 12 first passes around the roller 18 as the tension sensor 20 maintains web tension. The web 12 then travels to and around the retractable idler roller 22 before being wrapped partially around the rotating drum 24 with the adhesive side of the web 12, if one exists, facing outwardly. This prevents the web 12 from adhering to the drum surface 26 and permits the web 12 to transfer to the cores by adhesion. Adhesion transfer to the cores with nonadhesive webs can be accomplished by placing adhesive directly on the cores. The web 12 travels in intimate contact with the drum 24 as the rotation of the rotating drum 24 passes the web 12 onto one of the wind-up spindles 28, 30.

The web 12 begins winding around the first wind-up spindle 28 and onto its core 14 which is mounted on the wind-up spindle 28 as shown in FIG. 1A. When winding on the first wind-up spindle 28, the first wind-up spindle 28 is located against the rotating drum 24 while the second wind-up spindle 30 is spaced from the rotating drum 24. As the web 12 is wound around the rotating drum 24 with the adhesive side out, the web 12 will adhere to its core 14 on the wind-up spindle 28. When the first wind-up spindle 28 has received the required length of web 12, the knife wheel 34 rotates at a surface speed equal to the surface speed of the rotating drum 24. The knife wheel 34 is rotated at a speed matched to the speed of the drum 24 by a knife drive (not shown) which is linked either mechanically or electrically to the drum 24. The knife drive is actuated when a predetermined length of web 12 has been wound. The knife wheel 34 is shifted into and out of engagement with the drum 24.

As the knife wheel 34 rotates and reaches the web 12, the cutting edge of the knife 32 contacts the web 12. The knife 32 cuts the web 12 as the web 12 rotates against the rotating drum 24 and a tab 38 is applied to the cut end of the web by a tab bar 52 which, as shown, can be located on the rotating wheel 34 adjacent the knife 32. The tab bar 52 applies a tab onto the web 12 in registration with the cut end 36 of the web 12. Alternative tab application assemblies can be used.

As the knife 32 cuts the web 12, the idler roller 22 is pivoted on its pivoting arm 42 on a radius centered at the center of the roller 18 away from the rotating drum 24 to lengthen the pass line between the idler roller 22 and the drum 24. The idler roller 22 pivots at a speed approximately equal to the web speed. This causes the web 12 to slide on the surface 26 of the drum 24. Since the rotating drum 24 continues to rotate at a constant speed, this creates a gap 44 between the cut ends 36 of the web 12 as shown in Figure 1B. The gap 44 is equal to the pass line length increase. Typically, this increase and therefore the gap 44 is 15 cm (6 in). A vacuum is applied to the web 12 through the rotating drum 24 to increase friction between the web 12 and the drum 24 and to keep the web 12 in close contact with the drum 24 during winding. When the web 12 slides on the drum surface 26 by pivoting the idler roller 22, the vacuum is used to control the sliding force of the web 12 on the drum 24 and to maintain a constant line tension.

To transfer the winding from the first wind-up spindle 28 to the second wind-up spindle 30, the first wind-up spindle 28 is moved away from the drum surface 26 as the gap 44 passes under the first wind-up spindle location. This is shown in FIG. 1C. This causes the incoming cut end 36 of the web 12 to pass by the first wind-up spindle 28 and continue onto the second wind-up spindle 30. The second wind-up spindle 30 is moved into contact with the rotating drum surface 26 as the first wind-up spindle 28 moves away, and the incoming cut end 36 adheres to the core 14 on the second wind-up spindle 30 and begins wrapping around the core 14.

During the winding portion of the operating cycle, the idler roller 22 slowly pivots toward the rotating drum 24 and returns to its position of short pass line shown in FIG. 1D. As the idler roller 22 moves toward this position, the pass line length between the idler roller 22 and rotating drum 24 decreases while the speed of the drum 24 increases slightly to maintain constant line tension and to take up the extra length of web 12. The drum speed increase depends on the actual return speed and is accomplished in the drive for the drum and is modified by the tension sensor signal.

When the desired amount of web 12 is wound around the core 14 on the second wind-up spindle 30, the winding is transferred from the second wind-up spindle 30 to the first wind-up spindle 28. First, the knife wheel 34 rotates to rotate the knife 32 into contact with the web 12 to cut the web 12, as shown in FIG. 1E. As the knife 32 cuts the web 12, the idler roller 22 pivots away from the rotating drum 24 to lengthen the pass line between the idler roller 22 and the drum 24 by sliding the web 12 on the surface 26 of the rotating drum 24 and create a tail gap 44. As shown in FIG. 1F, the first wind-up spindle 28 is moved into contact with the rotating drum surface 26 as the gap 44 passes under the first wind-up spindle location to cause the incoming cut end 36 of the web 12 to wind on the first wind-up spindle 28. The second wind-up spindle 30 remains in contact with the rotating drum 24 until the tail end of the web 12 is completely wound around the roll on its core 14. Then the second wind-up spindle 30 moves away from the rotating drum 24. As the winding begins again on the first wind-up spindle 28, the idler roller 22 slowly returns to its position of short pass line shown in FIG. 1A, and the cycle begins anew.

This winding system 10 increases the time available to perform the transfer between the two wind-up spindles 28, 30 with a greatly simplified design. By creating a tail gap 44, the cut end of the web 36 is pulled away from the knife 32 after the web 12 is cut to prevent the cut ends 36 of the web 12 from sticking to each other or to the knife 32. Additionally, the gap 44 prevents the web 12 from contacting the core 14 prematurely and obviates the need to strip the web 12 off of the core 14 during any part of the cut and transfer cycle as with known drum winding equipment. The cut and transfer is made on the fly at full line speed with the upstream web speed and rotational inertia through the roller 18 and idler roller 22 remaining constant. This eliminates speed and inertia-related upsets from the upstream equipment.

This system can be used on continuous or noncontinuous-speed drum winders, with slit or unslit webs, and with or without adhesive-coated webs. This system also can be used where turrets or other mechanisms move the wind-up spindles into wind-up position, as where the incoming wind-up spindle is moved into contact with the drum while the gap is at that spindle location. However, the tail gap simplifies the transfer operation to a sufficient degree to obviate the need for turret mechanisms. Moreover, this winding system is simpler, less expensive, more versatile, and more reliable than known winding machines.

One winding system which can use this invention winds webs having widths of 63.5 cm (25 in) around paper or plastic cores that are 73.67 cm (29 in) long and have 7.62 cm (3 in) inner diameters. The core wall thickness can range from 0.25 to 1.02 cm (0.10 to 0.40 in), and rolls of up to 43.2 cm (17 in) in diameter can be formed with the actual size being operator selectable. As there are no thickness or material limitations on the web, glass and cotton cloth, nonwoven films, composites, and webs with high strength backings with thick adhesive can be used.

Web winding speeds of up to 120 m/min (400 ft/min) have been attained. The system can cycle by removing a full log on a core and loading a new core in 8 seconds and can wind with center winding or surface winding with center assist. In surface winding the wind-up roll remains in contact with the drum 24 during the entire wind-up process and in center winding the wind-up roll contacts the drum only during the first and last wraps with the wind-up torque being supplied through only the center of the wind-up roll at other times.

This winding system 10 provides a gap without causing web tension upsets from roll inertia. Since the rotational inertia of the rotating drum 24 remains constant throughout the gap generation, there is no inertial change to impart web tension upsets to the web 12. This is accomplished simply by the geometry of the system 10. Roll inertia problems can be overcome by other systems. For example, a precision drive could be used on each roller affected by rotational speed changes to power the roller at the precise speed profile required to match the web speed at that roller and prevent roll inertia from upsetting web tension. Also, rollers could be replaced by slider or floatation bars on which the web freely slides to avoid upset web tension.

Numerous characteristics, advantages, and embodiments of the invention have been described in detail in the foregoing description with reference to the accompanying drawings. However, the disclosure is illustrative only and the invention is not intended to be limited to the precise embodiments illustrated. Various changes and modifications may be effected therein by one skilled in the art without departing from the scope or spirit of the invention.

I claim:

1. A winding system for winding a web on cores mounted on respective first and second wind up spindles and for transferring the web between cores on the fly, comprising:

a first roller around which the web winds;

a rotating drum located downline of the first roller such that the web travels in contact with a portion of the surface of the rotating drum;

a retractable idler roller located between the first roller and the rotating drum, wherein the idler roller is movable toward and away from the rotating drum;

a cutter to cut the web;

means for moving the idler roller away from the rotating drum immediately after the web is cut to lengthen the distance between the idler roller and the rotating drum to cause the web to slide on the surface of the rotating drum, thereby creating a gap between the cut ends of the web; and means for transferring the web from the core mounted on the first wind-up spindle to the core mounted on the second wind-up spindle.

2. The winding system of claim 1 further comprising:

a first wind-up spindle on which a core is mountable, wherein the first wind-up spindle is movable between a first position in which a core mounted on the first spindle is in contact with the rotating drum and a second position spaced away from the rotating drum; and a second wind-up spindle on which a core is mountable, wherein the second wind-up spindle is located downweb of the first wind-up spindle and is movable between a first position in which a core mounted on the second spindle is in contact with the rotating drum and a second position spaced away from the rotating drum.

3. The winding system of claim 1 wherein the means for transferring the web from the first wind-up spindle to the second wind-up spindle comprises means for moving the first wind-up spindle from the first position to the second position as the gap passes under the first wind-up spindle location, means for moving the second wind-up spindle from the second position to the first position as the first wind-up spindle moves away, and means for winding the incoming cut edge around a core mounted on the second wind-up spindle.

4. The winding system of claim 1 further comprising means for transferring the web from the second wind-up spindle to the first wind-up spindle comprising means for moving the first wind-up spindle from the second position to the first position as the gap passes under the first wind-up spindle location to cause the incoming edge of the web to wind on the first wind-up spindle, means for maintaining the second wind-up spindle in the first position until the tail end of the web is completely wound around the second wind-up spindle, means for moving the second wind-up spindle from the first position to the second position, and winding the incoming cut edge around a core mounted on the first wind-up spindle.

5. The winding system of claim 1 wherein the idler roller is pivotable and further comprising means for pivoting the idler roller toward the rotating drum to decrease the distance between the idler roller and rotating drum while the speed of the drum increases to maintain constant line tension and to take up the extra length of web during winding.

6. The winding system of claim 5 wherein the idler roller is pivotable on a radius centered at the center of the first roller.

7. The winding system of claim 5 wherein the idler roller and the first roller have the same circumference.

8. The winding system of claim 1 further comprising means for applying a tab to the web in registration with at least one of the cut ends of the web.

9. The winding system of claim 1 wherein the rotating drum comprises means for increasing friction between the web and the rotating drum and for maintaining the web in contact with the rotating drum during winding.

10. The winding system of claim 9 wherein the friction increasing and contact maintaining means comprises a vacuum applied to the web through the rotating drum wherein when the web slides on the rotating drum surface by pivoting the idler roller, the vacuum controls the sliding force of the web on the rotating drum and to maintain a constant line tension.

11. A method of transferring a web from a first core on a first wind-up spindle to a second core on a second wind-up spindle after the web is transported around a first roller, transported to and around a retractable idler roller, wrapped partially around a rotating drum such that the web travels in contact with a portion of the surface of the drum, transported from the rotating drum onto the first core, wound around the first core until the first core has received a predetermined length of web, and cut, the method comprising the steps of:

lengthening the distance between the idler roller and the rotating drum after the web has been cut to cause the web to slide on the surface of the rotating drum and to create a gap between the cut ends of the web;

moving the first wind-up spindle away from the rotating drum surface as the gap passes under the first wind-up spindle location;

moving the second core into contact with the rotating drum surface as the first wind-up spindle moves away; and winding the incoming cut end around the second core.

12. The method of claim 11 further comprising the step of decreasing the distance between the idler roller and rotating drum while the speed of the drum increases to maintain constant line tension and to take up the extra length of web during the winding portion of the operating cycle.

13. The method of claim 12 wherein the lengthening step comprises moving the idler roller away from the rotating drum.

14. The method of claim 13 wherein the decreasing step comprise moving the idler roller toward the rotating drum.

15. The method of claim 11, further comprising the step of applying a tab to the web in registration with at least one of the cut ends.

16. A method of transferring a web from a second core on a second wind-up spindle to a first core on a first wind-up spindle after the web is transported around a first roller, transported to and around a retractable idler roller, wrapped partially around a rotating drum such that the web travels in contact with a portion of the surface of the drum, transported from the rotating drum onto the second core, wound around the second core until the second core has received a predetermined length of web, and cut, the method comprising the steps of:

lengthening the distance between the idler roller and the rotating drum after the web has been cut to cause the web to slide on the surface of the rotating drum and to create a gap between the cut ends of the web;

moving the first core into contact with the rotating drum surface as the gap passes under the first wind-up spindle location to cause the incoming edge of the web to wind on the first core;

maintaining the second core in contact with the rotating drum until the tail end of the web is completely wound around the second core;

moving the second wind-up spindle away from the rotating drum surface; and winding the incoming edge around the first core.

17. The method of claim 16 further comprising the step of decreasing the distance between the idler roller and rotating drum while the speed of the drum increases to maintain constant line tension and to take up the extra length of web during the winding portion of the operating cycle.

18. The method of claim 17 wherein the lengthening step comprises moving the idler roller away from the rotating drum.

19. The method of claim 18 wherein the decreasing step comprise moving the idler roller toward the rotating drum.

20. The method of claim 16, further comprising the step of applying a tab to the web in registration with at least one of the cut ends.

* * * * *